US005626551A

United States Patent [19]

Kearns et al.

[11] Patent Number: 5,626,551

[45] Date of Patent: May 6, 1997

[54] GREETING CARD KIT AND METHOD

[76] Inventors: Elizabeth J. Kearns, 1425 Cuyahoga St., Akron, Ohio 44313; Bethany L. Miller, 613 Tallmadge Ave., Kent, Ohio 44240

[21] Appl. No.: 372,108

[22] Filed: Jan. 13, 1995

[51] Int. Cl.[6] ..... B31B 1/26

[52] U.S. Cl. ..... 493/231; 493/264; 493/405; 493/458; 493/917; 40/124.01; 206/232; 229/92.8

[58] Field of Search ..... 493/395, 397, 493/405, 458, 466, 473, 475, 917, 944, 955, 959, 231, 254, 263, 264, 268, 356, 468, 91.7; 40/124.1; 206/232, 575; 229/92.8, 300, 301, 69, 75

[56] References Cited

U.S. PATENT DOCUMENTS

| | | | |
|---|---|---|---|
| 624,347 | 5/1899 | Levy . | |
| 1,999,314 | 4/1935 | Anderson | 493/397 |
| 2,360,916 | 10/1944 | Von Trott | 46/35 |
| 3,595,554 | 7/1971 | Donovan | 269/2 |
| 3,718,277 | 2/1973 | Volkert | 229/92.8 |
| 3,883,069 | 5/1975 | Volkert | 229/73 |
| 3,883,161 | 5/1975 | McGee | 283/50 |
| 4,055,690 | 10/1977 | Patterson | 428/9 |
| 4,239,410 | 12/1980 | Pianta | 402/20 |
| 4,439,941 | 4/1984 | Halperin | 40/124.1 |
| 4,487,431 | 12/1984 | Kelly | 206/232 |
| 4,566,720 | 1/1986 | Goldman | 281/15 R |
| 4,613,157 | 9/1986 | Drabish | 283/1 R |
| 4,714,275 | 12/1987 | Engel et al. | 40/124.1 |
| 4,795,195 | 1/1989 | McClain, Jr. | 282/56 |
| 4,809,904 | 3/1989 | Yasutaniya | 229/75 |
| 4,813,902 | 3/1989 | Messer | 446/71 |
| 4,828,497 | 5/1989 | Kurgan | 434/96 |
| 4,852,268 | 8/1989 | Sutherland | 33/562 |
| 4,997,126 | 3/1991 | Amos | 229/92.8 |
| 5,004,271 | 4/1991 | Piatt | 283/65 |
| 5,015,137 | 5/1991 | Stenner | 412/1 |
| 5,135,157 | 8/1992 | Cruz | 229/92.8 |
| 5,141,252 | 8/1992 | Michlin | 229/301 |
| 5,167,998 | 12/1992 | Hato | 229/92.8 |
| 5,219,184 | 6/1993 | Wolf | 283/56 |
| 5,227,209 | 7/1993 | Garland | 428/40 |
| 5,232,087 | 8/1993 | Schluger | 206/45.29 |
| 5,232,088 | 8/1993 | Leondidis | 206/223 |
| 5,284,365 | 2/1994 | Stuart | 283/117 |
| 5,318,327 | 6/1994 | Daneshvar | 283/117 |
| 5,333,909 | 8/1994 | Hedge, Jr. | 40/124.1 |
| 5,348,526 | 9/1994 | Feygin | 493/458 |
| 5,359,793 | 11/1994 | Copperstone | 40/124.1 |
| 5,378,222 | 1/1995 | Weber | 493/405 |
| 5,457,904 | 10/1995 | Colvin | 40/119 |

FOREIGN PATENT DOCUMENTS

| | | | |
|---|---|---|---|
| 567384 | 10/1975 | Sweden | 229/69 |

*Primary Examiner*—Joseph J. Hail, III
*Assistant Examiner*—Christopher W. Day
*Attorney, Agent, or Firm*—Oldham & Oldham Co., LPA

[57] ABSTRACT

The present invention is directed to a kit containing the required elements to enable one to manufacture his or her own greeting cards, note cards, and/or envelopes. The invention also relates to a method of manufacturing a greeting card, note card, or an envelope from ordinary paper stock or from paper stock containing decorative scenes thereon. An example of decorative paper stock which may be suitable for use with the kit is the glossy decorative paper stock which is used within some magazines. The kit is preferably provided in booklet form and includes templates to assist one in manufacturing cards and/or envelopes. The kit typically includes pieces of paper stock which have decorative scenes printed thereon which are suitable for use in manufacturing cards and envelopes. The kit typically will also include numerous pieces of plain or substantially plain paper stock which are suitable for use in forming envelopes and/or cards and which have a writing surface. Various stickers may be provided in the kit. For example, plain or substantially plain stickers may be provided and adhered to the envelope to allow one to write an address thereon. Also, decorative stickers may be provided and be used to assemble the envelope or seal the envelope after a card or letter is placed therein.

22 Claims, 3 Drawing Sheets

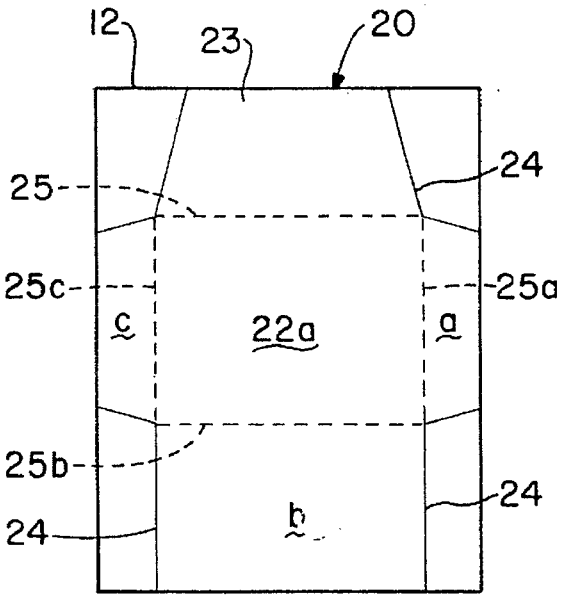
FIG.-2A
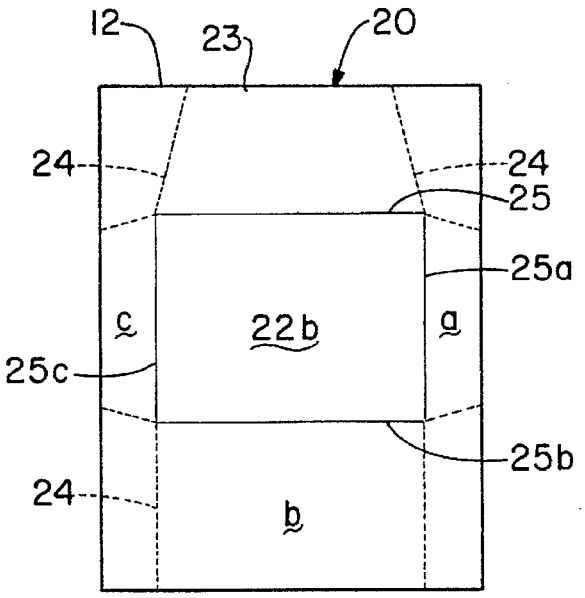
FIG.-2B
FIG.-3
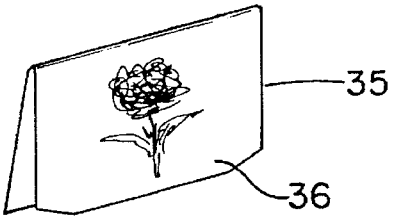
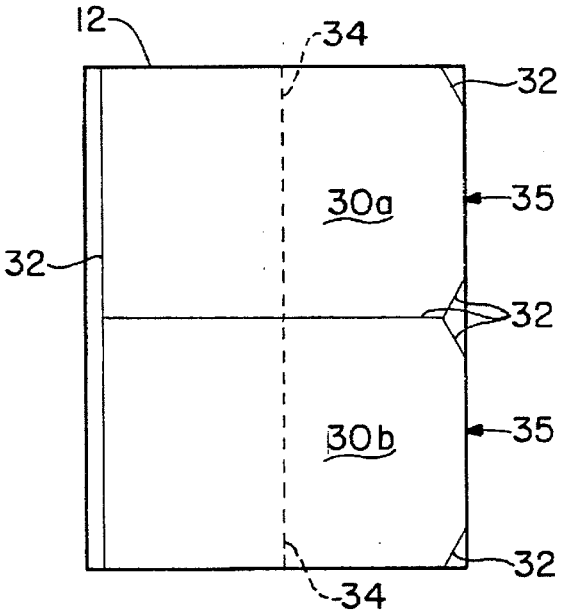
FIG.-3A
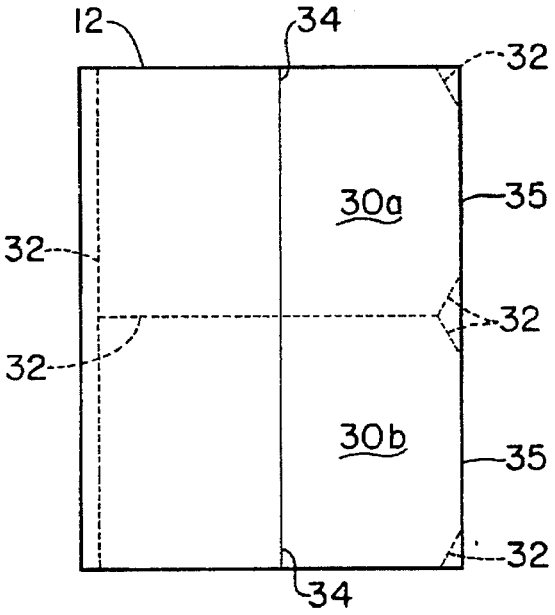
FIG.-3B

GREETING CARD KIT AND METHOD

FIELD OF THE INVENTION

This invention relates generally to greeting cards and note cards more particularly to a kit containing the requisite components for making such cards and/or envelopes to contain the same. The invention also relates to a method for manufacturing a greeting card, note card, or an envelope from paper stock.

BACKGROUND OF THE INVENTION

Greeting cards and/or note cards have long been used by people to express their emotions to others. Typically, one desiring to send a greeting card or a note card to another must travel to a store and purchase a decorative card containing a message printed thereon. Alternatively, one may desire to purchase a note card or stationary which is primarily blank but is decorated in an aesthetically pleasing manner, and on which can be written a personalized message. For example, such cards may be decorated to correspond to a certain theme such as a baby shower or a wedding. Although a wide variety of greeting cards or note cards are available, it is sometimes difficult to find a card containing the desired message or theme. The store-bought cards may also not include a variety of themes and are not customized for an individual or by the sender.

Also, greeting cards and note cards have become increasingly expensive. This has led some to manufacture their own cards containing the desired message or theme. This has also led to the recent development of machines which are placed in card shops and which allow consumers to manipulate text and artistic images to custom design a card. The above attempted solutions to the problem of not being able to find a desirable greeting card or note card are not entirely satisfactory. The latter method utilizing the machines, is an expensive method, is not available in all areas, and still requires that one travel to a store. The former method of manufacturing greeting cards or note cards without the aid of a kit, leads to cards which often do not have the desired professional appearance.

SUMMARY OF THE INVENTION

The present invention is therefore directed to a kit containing the required elements to enable one to manufacture his or her own greeting cards, note cards, or envelopes. The invention also discloses a method of manufacturing a greeting card, note card, or an envelope from ordinary paper stock or from paper stock containing decorative scenes or material thereon. An example of decorative paper stock which may be suitable for use with the kit is the glossy decorative paper stock which is used within some magazines. The kit is preferably provided in booklet form and comprises envelope template means for forming an envelope from a piece of paper stock. The kit preferably further comprises card template means for forming a card from a piece of paper stock. The kit preferably further comprises a plurality of pieces of paper stock which have decorative scenes printed thereon, being suitable for use in manufacturing cards and envelopes. The kit preferably also includes a plurality of pieces of plain or colored paper stock which is suitable for use in forming envelopes and cards and which also provides a suitable writing surface.

In another preferred embodiment, the invention may further comprise stickers or other adhesive components designed to facilitate the assembly of the card and/or the envelope. The kit may further comprise address labels which preferably are self-adhesive and are designed to be adhered to the face of an envelope to facilitate the addressing of the envelope or the return addressing of the envelope.

The present invention is also directed to a method of manufacturing a greeting card, note card, and/or an envelope from paper stock.

BRIEF DESCRIPTION OF THE DRAWINGS

FIG. 2A is a plan view of a page including an envelope template;

FIG. 2B is a plan view of an alternative envelope template to that shown in FIG. 2A;

FIG. 3 is a perspective view of a card manufactured using the kit and methods described herein;

FIG. 3A is a plan view of a page including a card template;

FIG. 3B is a plan view of an alternative card template; and

DETAILED DESCRIPTION OF THE PREFERRED EMBODIMENT

Figure 1:
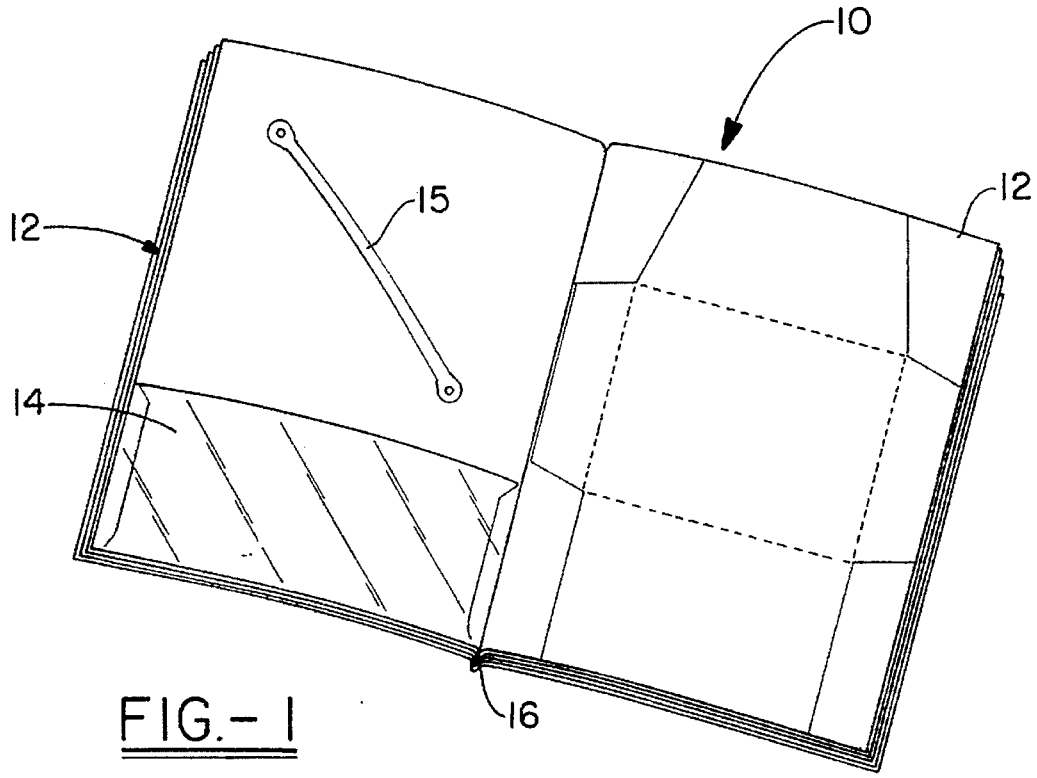
FIG. 1 is a perspective view of the kit of the present invention in its preferable booklet form.
Figure 1A:
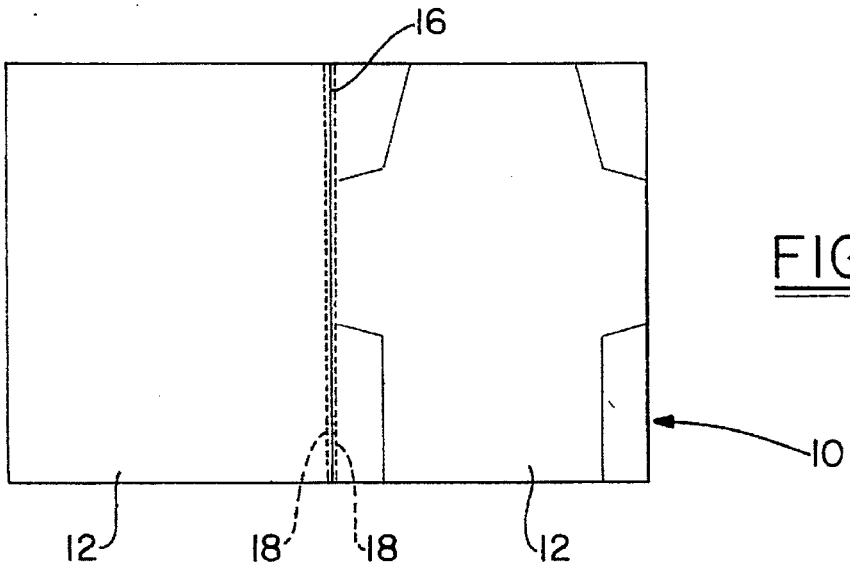
FIG. 1A is a plan view of the open booklet shown in FIG. 1.

The kit of the present invention is shown generally as booklet or magazine 10 in FIG. 1, though the contents of the kit may be provided in any suitable form. Booklet 10 preferably contains a plurality of pages 12 which are, or contain thereon, various elements of the kit as will be described hereinbelow, and also preferably includes instructions on a page 12 describing how the kit may be utilized to manufacture envelopes, greeting cards, note cards, or the like. Pages 12 are preferably releasably disposed in booklet using means known in the art to allow pages 12 to be easily removed from booklet 10. For example, booklet pages 12, as seen in FIG. 1A, include perforations 18 at their respective inner edges near binding 16 to allow pages 12 to be easily separated and removed from the booklet 10. Other suitable means to allow the pages 12 to be removed are contemplated or, alternatively, pages 12 may simply be cut from booklet 10.

Figure 2:
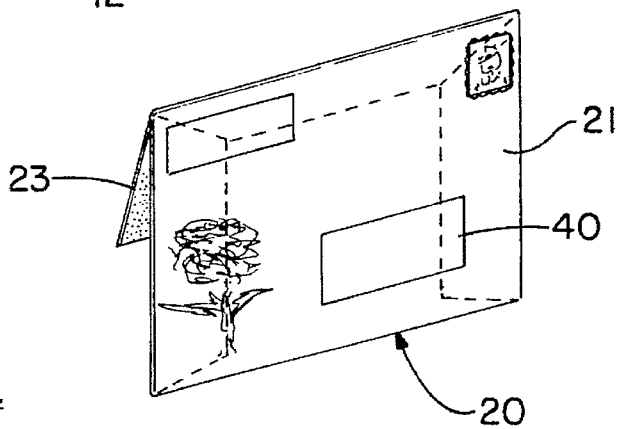
FIG. 2 is a perspective view of an envelope manufactured using the kit and method described herein.

As seen in FIG. 2, an envelope 20 may be formed using envelope template 22*a*, 22*b* as respectively shown in more detail in FIGS. 2A and 2B. Envelope templates 22*a*, 22*b* are included on pages 12 of booklet 10 which are preferably made from a heavy paper stock or cardboard, although a various other suitable materials, such as plastics, exist and may be utilized. Pages 12 containing envelope templates 22*a*, 22*b* are preferably similarly releasably secured within booklet 10 using perforations or a variety of other means, which include, for example, securing pages 12 within booklet 10 with an adhesive or with a special binding means to allow envelope templates pages 12 to be easily removed from booklet 10.

Envelope templates 22*a*, 22*b* are preferably drawn or otherwise defined or indicated on pages 12 by one or more perimeter lines 24 (shown as solid lines) printed, embedded, or otherwise disposed on at least one surface of a page 12.

Envelope templates 22*a*, 22*b* are preferably provided with at least one "fold-line" 25 (shown as broken lines) printed or otherwise indicated on at least one surface thereof as a dashed line or otherwise distinguishable from perimeter lines 24. In an alternative embodiment, the one or more perimeter lines 24 may be suitably formed by scoring, perforating, or otherwise to form a weakened zone in the template sheets to allow templates 22*a*, 22*b* to be easily removed from their respective pages 12. Although perimeter lines 24 and/or fold lines 25 are preferably provided on templates 22*a*, 22*b*, booklet 10 may be provided with blank envelope template sheets from which one may cut, or upon which one may draw, an envelope template 22*a*, 22*b* having any alternate configuration they desire.

To use either of envelope templates 22*a*, 22*b* to manufacture an envelope 20, one must first select a suitable piece of envelope paper stock which is preferably provided with the kit 10. The envelope paper stock is preferably a high quality paper which may be colored or have aesthetically pleasing graphic material, such as a decorative scene or image, on at least one surface thereof. Booklet 10 preferably contains a plurality of pieces of suitable envelope paper stock having different graphic material disposed thereon as pages 12, which allows one having a kit to easily select a desired piece of paper stock. In the preferred embodiment, the paper stock may include a glossy photographic scene, theme oriented graphics, or other decorative pictures as desired, although a plain piece of envelope paper stock may be utilized. In addition to the envelope paper stock provided as pages 12 of booklet 10, a wide variety of other paper stock is usable with envelope templates provided in the kit to make a suitable envelope. For example, many magazines utilize glossy paper stock having a wide variety of images thereon which correspond to the theme of the magazine. These pages may be cut or otherwise removed from a magazine to be utilized as envelope paper stock.

When a suitable piece of envelope paper stock has been selected, it is temporarily secured adjacent to a page 12, which contains an envelope template 22*a*, 22*b* indicated thereon, using a plurality of paper clips or other such fasteners, so that the perimeter lines 24 of template 22*a*, 22*b* remain visible. Using scissors or a sharp implement, one cuts along the perimeter lines 24. Alternatively, the one or more perimeter lines can be formed as weakened zones by scoring or perforating, and the template 22*a*, 22*b* may be easily separated from the page 12. The perimeter of the template 22*a*, 22*b* may then be traced upon a piece of envelope paper stock, which may then be cut to the proper shape to form envelope 20. Alternatively, rather than tracing template 22*a*, 22*b*, one may simply cut a piece of envelope paper stock to conform to the perimeter of template 22*a*, 22*b*. After being cut with the help of template 22*a*, 22*b*, the envelope paper stock has the required shape to be formed into an envelope 20. This is preferably accomplished by folding envelope paper stock along fold-lines 25 after the above cutting operation is complete. Folding of envelope paper stock preferably occurs while envelope paper stock is fastened to envelope template 22*a*, 22*b* however, envelope paper stock may alternatively be separated from template 22*a*, 22*b* prior to any folding operations. Flaps a, b, c are preferably folded inward relative to each other along fold lines 25*a*, 25*b*, 25*c*, respectively, and are fastened, using a glue stick, paste, stickers, staples, or others means known in the art, over at least a portion of the points where they meet to form envelope 20. Rubber cement is an example of one suitable adhesive which may be utilized to manufacture envelope 20.

Figure 4:
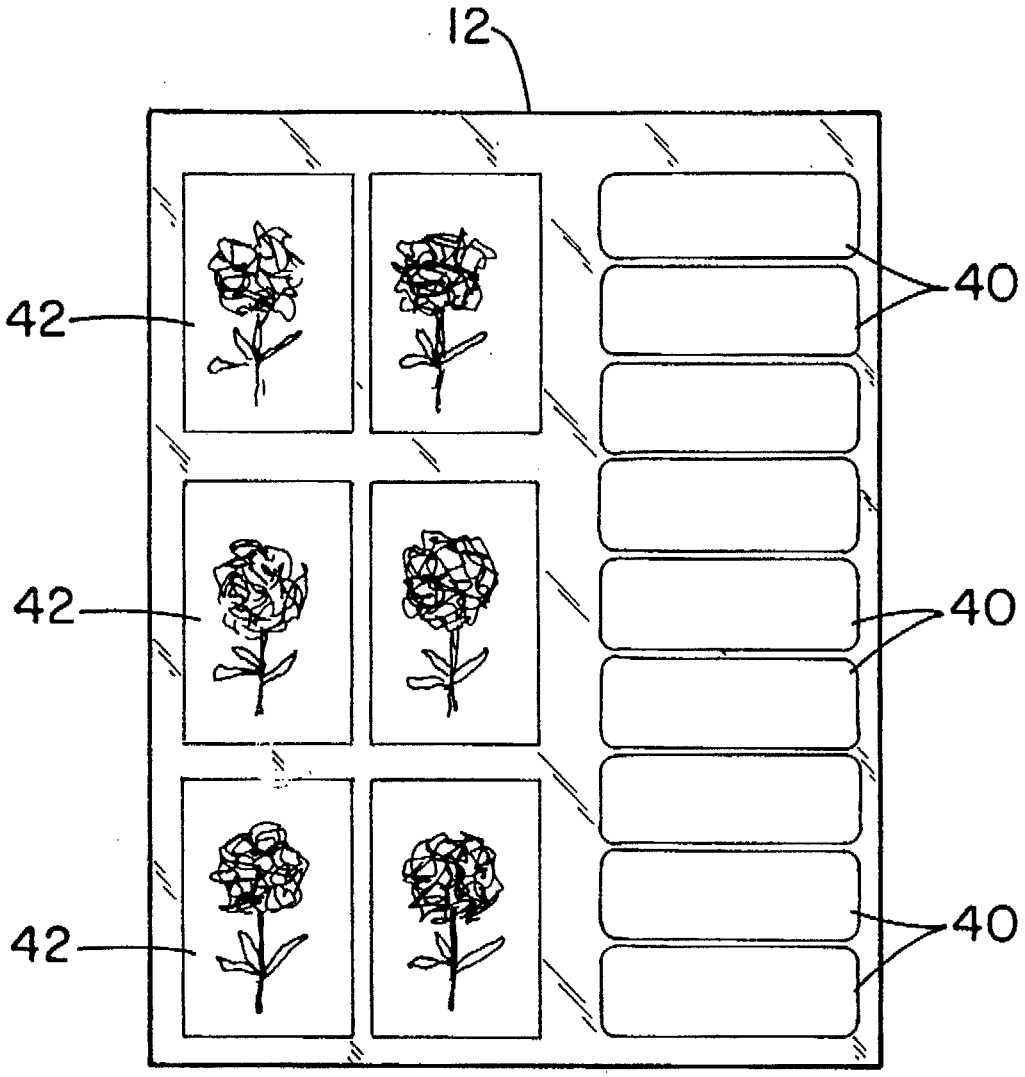
FIG. 4 depicts a page of the kit of the present invention as containing address and assembly stickers which are preferably provided with the kit.

Booklet 10 is also preferably provided with a page 12 including a plurality of address labels 40, as seen in FIG. 4, which may be applied to the front 21 of envelope 20, as seen in FIG. 2, or the back of envelope 20 to provide a suitable surface upon which to write the address or the return address. The address labels 40 may also be used to seal envelope 20 if applied to seal the rear flap 23. As an alternative to using address labels 40, envelope paper stock may be provided with an undecorated area for writing an address or a return address. Booklet 10 preferably further comprises a plurality of sealing stickers 42, as seen in FIG. 4, which may be used for sealing the rear flap 23 of envelope 20 for delivery and/or may be used in place of glue or other fastening means to secure flaps a, b, c when assembling envelope 20. Address labels 40 may also be used to secure flaps a, b, c when assembling envelope 20.

Those skilled in the art will recognize that many different shapes of envelopes are ultimately obtainable by providing envelope templates 22*a*, 22*b* with different perimeter lines 24 and/or different fold lines 25. Because envelope templates 22*a*, 22*b* will be cut or otherwise separated from page 12 after their first use, templates 22*a*, 22*b* may be re-used by tracing their perimeter onto a piece of paper stock and subsequently cutting the paper stock along the tracing lines, or by temporarily being fastening the template 22*a*, 22*b* adjacent to a piece of paper stock which may be trimmed to conform to perimeter shape of template 22*a*, 22*b*. In an alternative embodiment, perimeter lines 24 of an envelope may be provided directly on a piece of envelope paper stock to allow an envelope 20 to be removed directly therefrom without use of a template 22*a*, 22*b*. The perimeter lines 24 of envelope template 22*a*, 22*b* may be simply printed for cutting out the envelope 20, or be provided as weakened zones on a piece of envelope paper stock. This would allow one to separate the envelope template 22*a*, 22*b* from the remainder of the page and fold the template 22*a*, 22*b* into an envelope 20. In such an embodiment, the envelope 20 could be provided with a suitable adhesive, such as a self-stick adhesive or a pressure sensitive adhesive including a protective release strip thereon. The adhesive would be applied to allow one to simply assemble an envelope 20.

Booklet 10 preferably also includes the required elements to manufacture a greeting card, note card, or other such card as seen at 35 in FIG. 3. Card templates 30*a*, 30*b* are drawn, defined, or otherwise indicated on pages 12 of booklet 10 which are preferably made from a heavy paper stock or cardboard, although various other suitable materials such as plastic may be used. Pages 12 containing card templates 30*a*, 30*b* indicated thereon are preferably releasably secured within booklet 10 using perforations (not shown) or a variety of other means, which include, for example, binding pages 12 within booklet 10 with an adhesive, or by using any other suitable binding to allow pages 12 to be easily removed from booklet 10.

One or more card templates 30*a*, 30*b* are preferably defined by one or more perimeter lines 32 (shown as unbroken lines) printed, embedded, or otherwise disposed on at least one surface of page 12. Card templates 30*a*, 30*b* are also preferably provided with at least, one "fold-line" 34 (shown as broken lines) printed or otherwise indicated on at least one surface of page 12 as a dashed line or otherwise distinguishable from perimeter lines 32. As discussed above in relation to envelope templates 22*a*, 22*b*, perimeter lines 32 may be formed as weakened zones in page 12 to allow the template 30*a*, 30*b* to be easily removed from the sheet.

Booklet 10 preferably also includes card paper stock to be used in conjunction with card templates 30*a*, 30*b* to form a card such as a note card, greeting card, or other such card. Card paper stock is preferably a high quality paper stock which is designed to provide a suitable writing surface. Card templates 30*a*, 30*b* are preferably of the size and shape so as to allow a card to be produced which can be used with envelope 20 made using envelope templates 22*a*, 22*b*. Booklet 10 also preferably includes a variety of pictures or other aesthetically pleasing decorative images formed on high quality glossy paper. If one desires to decorate card 35, these images are designed to be cut from booklet 10 and pasted, glued, or otherwise disposed upon the formed card 35 such as on the front surface 36. The portion of the decorative image which overhangs front 36 of card 35 may be trimmed to provide an aesthetically pleasing card 35 to be used with envelope 20.

To form card 35, one selects a suitable piece of card paper stock which is preferably provided as a sheet or page 12 in booklet 10. Card paper stock may be provided in pre-cut sheets which are sized to correspond to envelope 20 made according to the above description, but card paper stock is preferably provided in the form of 8½"×11" sheets. To form a card 35, one may simply cut a piece of card paper stock into the size and shape desired, without using a card template 30*a*, 30*b*. For example, one may simply cut a piece of 8½"×11" card paper stock horizontally at its midsection to form two cards, each 4¼"×5½" in size. Those skilled in the art will recognize that card paper stock or envelope paper stock may provided in any number of shapes and sizes, and may be cut into other shapes and sizes as desired, and the invention is not limited to the arrangement disclosed. Card paper stock may alternatively be formed into a desired shape using either of card templates 30*a*, 30*b*. Card templates 30*a*, 30*b* are used in a manner similar to envelope templates 22*a*, 22*b* as described above, to allow one to form a card 35 having the desired shape. One of the card templates 30*a*, 30*b* may be temporarily secured, using paper clips or other suitable temporary fasteners, adjacent to a piece of card paper stock. Using a scissors or other cutting implement, one simply cuts along the perimeter lines 32 to form a card 35 of the desired shape. Alternatively, the perimeter lines 32 of card template 30*a*, 30*b* may be formed in a page 12 the sheet by scoring, perforating, or otherwise to form a weakened zone in page 12. Template 30*a*, 30*b* may then be removed from page 12 and its outline may be traced onto a piece of card paper stock which may be subsequently cut into a card 35, or, card template may be temporarily secured adjacent to a sheet of card paper stock which may then be trimmed to conform to the shape of the perimeter of the card template 30*a*, 30*b*. Card templates 30*a*, 30*b* are preferably designed to allow two cards to be clot from each piece of 8½"×11" card paper stock. As has been previously mentioned, the use of card templates 30*a*, 30*b* is optional. Card 35 may simply be cut from card paper stock in any shape desired, and folded in any suitable manner known in the art. Card template 30*a*, 30*b* perimeter lines 32 and/or fold lines 34 may be indicated directly on a page 12 of card paper stock to allow a card 35 to be cut directly therefrom. Also, card template 30*a*, 30*b* perimeter lines 32 may be formed as weakened zones in a piece of card paper stock to allow a card 35 to be easily removed from the remainder of the piece of card paper stock.

Booklet 10 preferably also includes retaining means, such as pocket 14, elastic band 15, clips, or others, for selectively retaining and storing the various elements of the kit, and other supplies while the elements or supplies are not in use. For example, envelope templates 22*a*, 22*b*, card templates 30*a*, 30*b*, paper stock, or adhesive labels 40, 42 may be secured in pocket 14 or with elastic band 15 or using other retaining means known in the art. Alternatively, a carrying case may be provided to conveniently carry booklet 10, and any other supplies such as scissors, rubber cement, clips, paper, and the like.

Based upon the foregoing, the kit of the invention provides all materials necessary to create a greeting card and an envelope, allowing the user to tailor make a card 35 for a particular occasion, or to, make a card 35 based upon a particular theme. The kit for creating a greeting card 35 allows the card 35 to be personalized for a particular occasion or event, with the kit including a variety of decorative materials, such as photographic images or other graphics or art work, which may be combined into a unique, one-of-a-kind card relating to a particular occasion or event, or relating to a particular person to whom the card 35 is to be sent. The decorative sheet material may also be provided with printed messages or the like relating to the occasion or event if desired. The kit includes the sheet materials which may be used in the construction of both the creating card or note card 35, as well as an envelope 20 used for mailing the card 35, with card and envelope pages constructed to provide rigidity or other characteristics to facilitate use as a card 35 or envelope 20. Decorative or graphic material may be placed on paper stock used to form the note card 35 or envelope 20, or the graphic material itself may be printed on materials suitable for these purposes. Matching or similar pictures, where one may be a faded or faintly drawn version of the other may be provided on card paper stock and envelope paper stock to allow one to manufacture a card 35 and a matching envelope 20. The paper stock may include, for example, Cartoon images to be colored in by a child. A variety of stencils may also be provided with the kit to allow one to decorate the paper stock as desired. Paper stock may be provided which includes different recipes or other information printed thereon.

A variety of different shaped templates may be used to create distinctive note card 35 or envelope 20 patterns from a blank sheet of material, and enable the user to create a card 35 and envelope 20 pair having a professional appearance. The kit preferably also includes address labels 40, stickers 42, seals 42, or other means to allow the constructed card 35 and envelope 20 to be sealed and mailed easily, with all resources necessary to create a finished, professional looking card 35 and envelope 20 set provided with the kit. It should be recognized that the kit provided in the form of a magazine-type booklet 10 allows materials in the kit to be directed to a particular theme or occasion. For example, the kit may include creations for all occasions such as for birthdays, congratulations, or other special events, with material relating to each theme presented as part of the magazine kit. Alternatively, the kit may be directed to a particular theme or occasion, such as birthday cards, Christmas cards or the like, with a variety of decorative or graphic material provided in the kit relating to the particular theme or occasion. As part of the material used to form a greeting card or note card 35, pages 17 in the kit may be provided with other materials, such as stickers, lace, or other decorative materials which are releasably secured within the booklet 10. Providing the kit with a variety of different decorative materials will allow the user to create a card 35 having a meaning with respect to a particular theme or occasion, or personalized for an individual, allowing a great amount of flexibility in design and use. Further, forming the kit in the form of a magazine or booklet 10 allows easy and convenient storage of the kit between uses, and allows a wide variety of decorative or graphic materials to be incorporated easily along with the kit. Providing the additional materials of address labels 40, seals 42, stickers 42, and the like also provide a finished, professional appearance to a created card 35, and simplifies use of the kit.

Those skilled in the art will recognize that cut-lines and/or fold-lines may be printed or otherwise disposed on at least one side of the envelope paper stock, and/or card paper stock to allow an envelope 20 or a card respectively, to be cut directly therefrom. Those skilled in the art will recognize that booklet 10 may be provided in the form to manufacture only envelopes 20 or cards 35, to be used with a card or envelope, respectively, of other origin, such as may be purchased. While the foregoing description has set forth the preferred embodiment of the invention in particular detail, it must be understood that numerous modifications, substitutions and changes can be undertaken without departing from the true spirit and scope of the present invention as defined by the ensuing claims.

What is claimed is:

1. A kit for manufacturing a greeting card and an envelope for mailing said greeting card, the kit comprising a booklet having a plurality of pages, said plurality of pages including at least one page of card paper stock from which a card is selectively removed and formed; and card template means for forming said at least one page of card paper stock into a decorative greeting card shape.

2. A kit as recited in claim 1, wherein, said card template means is provided as at least part of a page of said booklet and is usable to form a respective page of said card paper stock into a predetermined decorative card shape.

3. A kit as recited in claim 1, further comprising, at least one page of envelope paper stock;

envelope template means provided as at least a part of a page of said booklet and usable to form a respective page of said envelope paper stock into a predetermined envelope shape.

4. A kit as recited in claim 3, wherein, said envelope template means is defined in said page of said kit by a weakened zone.

5. A kit as recited in claim 1, wherein, said at least one page of envelope paper stock includes a decorative image disposed on at least one side thereof.

6. A kit as recited in claim 1, further comprising, at least one page of paper stock containing at least one decorative image disposed thereon, said image suitable for being selectively removed from said page of paper stock and attached adjacent to a card formed from said at least one piece of card paper stock.

7. A kit as recited in claim 1, further comprising, at least one adhesive address label releasably provided on a page of said booklet, said at least one address label suitable for being applied to said envelope to provide a address writing surface.

8. A kit as recited in claim 1, further comprising, at least one decorative sticker releasably provided on a page of said booklet, said at least one decorative sticker suitable for use in sealing said envelope.

9. A kit as recited in claim 1, wherein, said card is defined in said at least one page of card paper stock by a weakened zone.

10. A kit as recited in claim 1, wherein, said card template means is defined in said page of said booklet by a weakened zone to allow said card template means to be selectively removed from said page.

11. A kit as recited in claim 1, wherein, said envelope is defined in said at least one page of envelope paper stock by a weakened zone.

12. A method of manufacturing a card and an envelope from a kit, said method comprising the steps of:

providing said kit in booklet form having a plurality of pages including at least one page of envelope paper stock, at least one page of card paper stock, at least one envelope template, and at least one card template;

selecting and removing an envelope template from said booklet;

selecting a piece of envelope paper stock;

using said envelope template with said piece of envelope paper stock to transfer the shape of said envelope template to said piece of envelope paper stock;

cutting said piece of envelope paper stock according to said envelope template;

folding said piece of envelope paper stock into the form of an envelope according to said envelope template;

fastening said folded piece of envelope paper stock upon itself at predetermined locations to form an envelope;

selecting and removing a piece of card paper stock from said booklet;

selecting and removing a card template from said booklet;

using said card template with said piece of card paper stock to transfer the shape of said card template to said card paper stock;

forming said piece of card paper stock into a card.

13. The method of claim 12, wherein, said step of using said card template with said piece of card paper stock is carried out by:

selecting a card template;

fastening said card template adjacent to said piece of card paper stock;

cutting said piece of card paper stock according to said card template;

separating said card template and said piece of card paper stock;

folding said piece of card paper stock into a card.

14. The method of claim 12, further comprising the steps of:

providing said booklet with at least one page having a decorative image disposed on at least one side thereof;

selecting and removing said decorative image from said at least one page having a decorative image; and securing said decorative image adjacent to a surface of said card.

15. A kit for making a greeting card comprising:

a booklet having a plurality of pages as a part thereof, said plurality of pages including at least one card template and at least one piece of card paper stock, said card template having at least one perimeter line defining said card template to have a predetermined shape used to produce a blank of material having said predetermined shape, with said blank material used to form a greeting card using said card paper stock.

16. The kit as in claim 15, wherein, said plurality of pages further include at least one page having an envelope template formed therein, said envelope template having at least one perimeter line defining a predetermined shape, and said plurality of pages further include at least one page of envelope paper stock, said envelope template being selectively removable from said page to be used to produce, from said envelope paper stock, a blank of material having said predetermined shape of said envelope template, said blank to be used to form an envelope in which said greeting card may be positioned for mailing.

17. A kit as recited in claim 16, further comprising, at least one adhesive label which is selectively removable from said kit for being applied to said envelope blank.

18. A kit as recited in claim 15, wherein, said at least one page of card paper stock has graphic images thereon, such that when said blank material is used to form a greeting card, said graphic material will appear on at least the exterior surface of said card.

19. A kit as recited in claim 15, wherein, said plurality of pages further includes at least one page having graphic material thereon, said graphic material being selectively removable from said page and being selectively secured to said blank material used to form said greeting card so as to appear as a part thereof.

20. A kit as recited in claim 15, further comprising, at least one adhesive label which is selectively removable from said kit to be applied to said blank material used to form said greeting card.

21. A kit as recited in claim 15, further comprising, a retaining means provided on at least one page of said booklet for selectively retaining and storing at least said card template while said card template is not in use.

22. A kit as in claim 15, wherein, said plurality of pages includes said pages from said booklet for use.

* * * * *